United States Patent [19]

Livingston

[11] Patent Number: 4,619,076

[45] Date of Patent: Oct. 28, 1986

[54] SAFETY CABINET LATCHING SYSTEM

[75] Inventor: Jerry L. Livingston, Humboldt, Ill.

[73] Assignee: Justrite Manufacturing Company, Mattoon, Ill.

[21] Appl. No.: 723,337

[22] Filed: Apr. 15, 1985

[51] Int. Cl.[4] ..... E05C 7/05

[52] U.S. Cl. ..... 49/367; 49/7; 49/395

[58] Field of Search ..... 49/367, 395, 7, 8

[56] References Cited

U.S. PATENT DOCUMENTS 1,909,697 5/1933 MacBeth et al ..... 49/395 X
3,023,068 2/1962 Haag ..... 312/263
3,403,954 10/1968 Williams ..... 312/351
4,146,994 4/1979 Williams ..... 49/367
4,262,448 4/1981 Flider ..... 49/367

*Primary Examiner*—Kenneth Downey
*Attorney, Agent, or Firm*—Irwin C. Alter

[57] ABSTRACT

A safety cabinet for the storage of flammable or combustible materials that has doors and a closure mechanism designed to automatically close and latch the doors in the event of fire. The closing mechanism is fully automatic and eliminates mechanical timing features as well as provides an automatic positive method and structure of closing the doors of the cabinet to insure a complete seal and lock.

4 Claims, 9 Drawing Figures

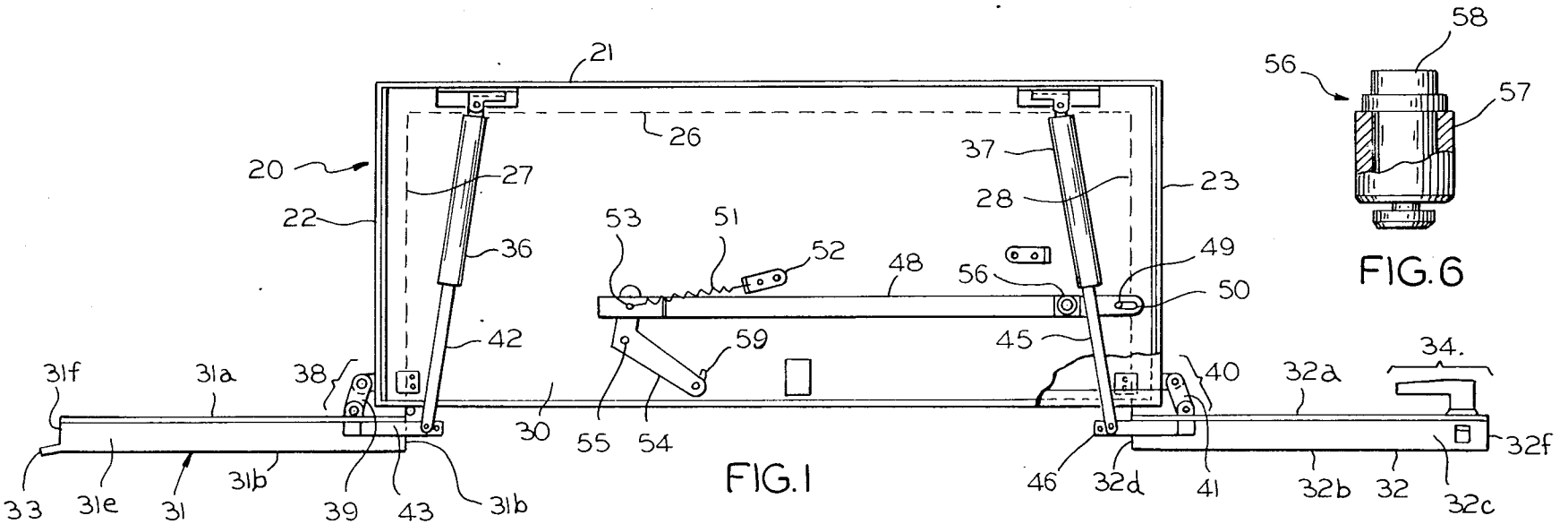
FIG.1
FIG.6
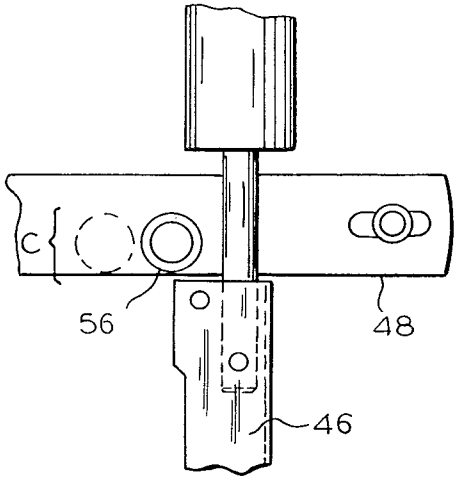
FIG.5
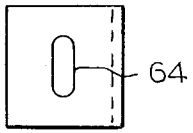
FIG.3
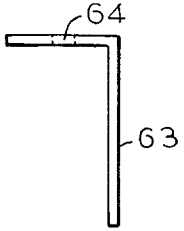
FIG.4
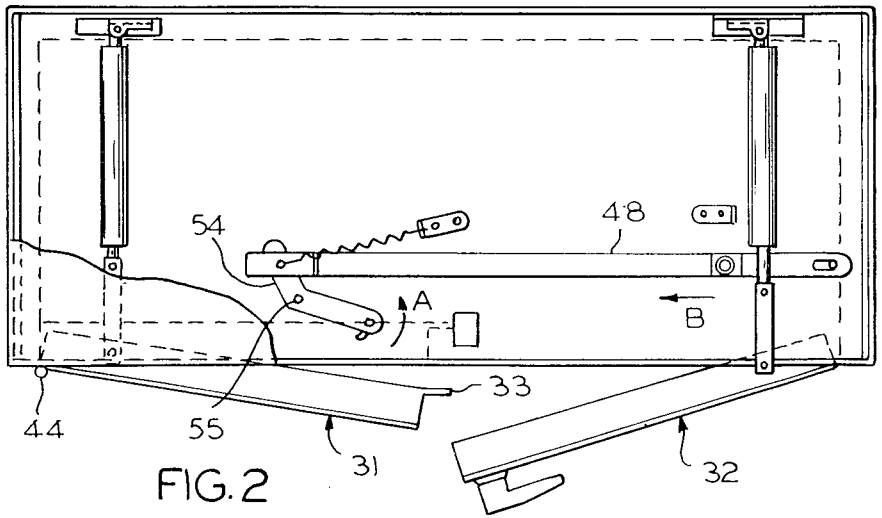
FIG.2

SAFETY CABINET LATCHING SYSTEM

The present invention relates generally to safety cabinets for flammable or explosive materials and, more particularly, to a safety cabinet having doors which automatically close and latch responsive to a detected rise in the ambient temperature caused by fire.

In U.S. Pat. No. 4,262,448, the advantages of automatically closing safety cabinets were enumerated. By providing an automatically locking safety cabinet, the need for storing flammable liquids outside of the plant was obviated. Where a fireproof cabinet can be provided to insulate inflammable material from the direct effects of a fire, spreading the effects of the original fire can be prevented. However, as is explained, where a container of flammable liquid must be stored in a locked cabinet which must be unlocked each time the material is to be used, employees undoubtedly ignore the necessity for locking up such liquids in favor of the convenience and heightened productivity which result when the liquid is freely and readily available. Thus, as taught in the previous patent, a fireproof cabinet was provided that has closures which automatically close and latch the cabinets responsive to conditions of combustion to eliminate the need for concern over the necessity for locking up the cabinets.

However, the system previously described relied on critical mechanical timing features since the latching system therein described required activation from a trip bracket. While the prior automatic door closure was acceptable in operation, the present invention is an improvement thereover since it provides an automatic positive method of closing while less maintenance and adjustment is needed.

Accordingly, the present invention has as one of its objects to not only provide fireproof cabinets having door closures which automatically close and latch responsive to conditions of combustion, but also to provide a simple and more positive closing mechanism for such devices whereby less maintenance in terms of adjustment is needed.

It is further an object of this invention to provide door closures for fireproof cabinets that are in the form which is simpler and more economical to manufacture and that can be conveniently used.

These and further objects of the invention will become more readily apparent upon consideration of the accompanying drawings wherein like characters of reference indicate corresponding parts:

FIG. 1 is a top view of a fire-proof cabinet and automatic door closure;

FIG. 2 shows the device of FIG. 1 with the doors partially closed;

FIG. 3 is a top view of the door latch guide;

FIG. 4 is a side view of the door latch guide shown in FIG. 3;

FIG. 5 is a detail drawing illustrating the mechanism holding one door of said cabinet in a partially open position;

FIG. 6 is a partial sectional view of the stop roller and stud assembly of FIG. 1:

Figure 8:
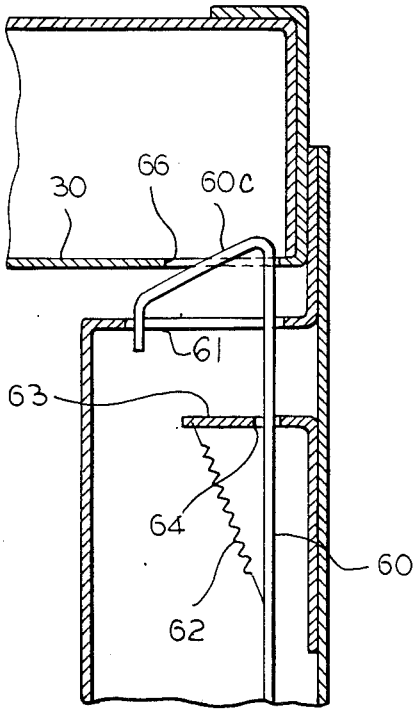
Figure 9:
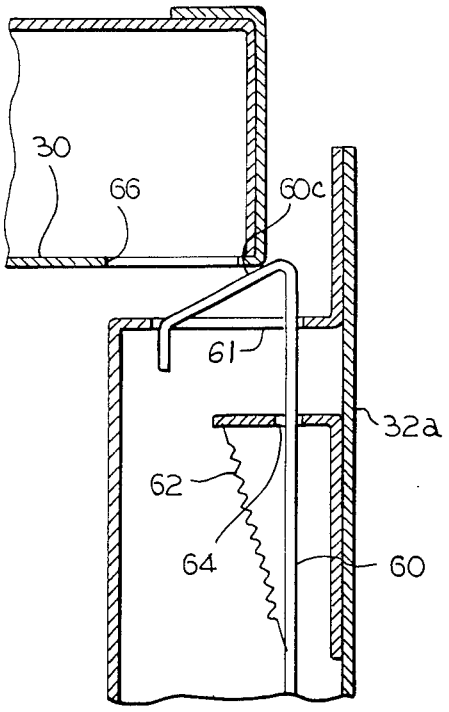

FIG. is a front elevational view of a cabinet showing the operation of the latch in phantom;

FIG. 8 is a partial sectional view illustrating the automatic latching mechanism in a closed position; and FIG. 9 is a view of the assembly in FIG. 8 showing the door open and moving to a closed position.

Figure 7:
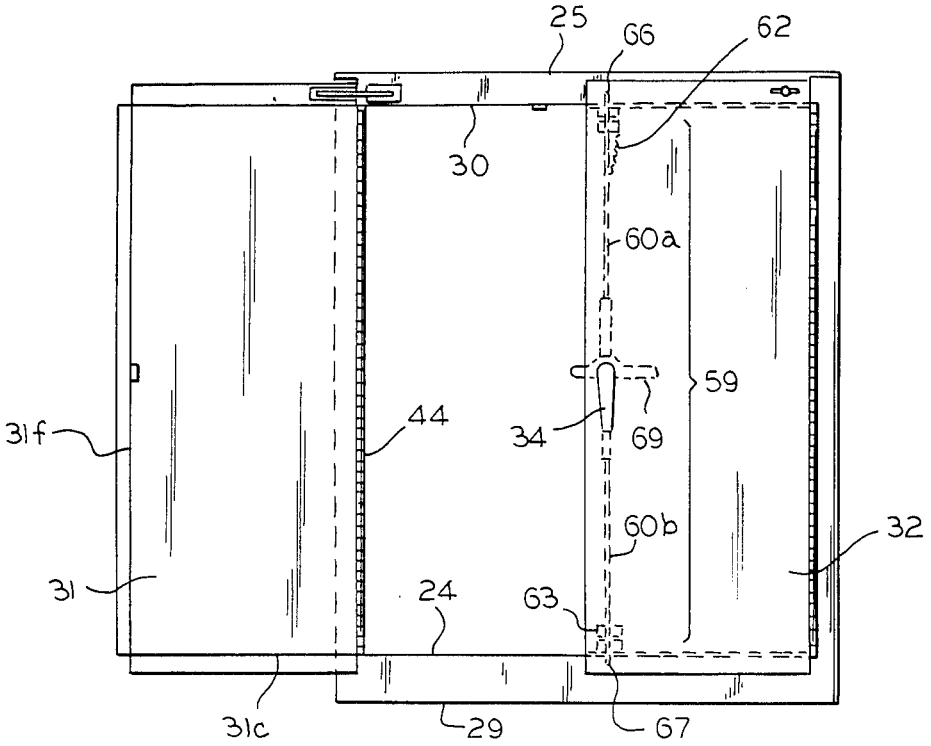

Referring now to FIG. 1, the numberal 20 indicates generally a fire-proof cabinet assembly having an outer rear wall 21, an outer left side wall 22, an outer right side wall 23, and an inner floor 24. As best seen in FIG. 7, cabinet 20 also has a top having an outer top wall 25.

In keeping with one preferred construction of fireproof cabinets, cabinet 20 is a double-walled construction, wherein each said wall has a corresponding inner wall, with said inner and outer walls separated by a dead air space. Thus, in FIG. 1, outer rear wall 21 has a corresponding inner rear wall 26, outer left side wall 22 and outer right side wall 23 have corresponding inner walls 27 and 28, respectively, while as best seen in FIG. 7, inner floor 24 has corresponding outer wall 29, and outer top 25 has a corresponding inner top wall 30.

As best seen in FIGS. 1 and 2, the front of cabinet 20 is selectively closed off by a pair of doors, with left hand door 31 having a similar double wall construction, with outer door front 31*a* spaced apart from inner door front 31*b*, by side walls 31*c*, 31*d*, 31*e* and 31*f* defining an enclosed dead air space. Right hand door 32 is of similar construction, with side walls 32*c*, 32*d*, 32*e* and 32*f* joining outer door front 32*a* and inner door front 32*b*.

In the embodiment illustrated in FIGS. 1 and 2, left hand door 31 has extended sealing lip 33 protruding along side wall 31*f*. Right hand door 32 has a latching mechanism generally indicated at 34 with which said cabinet may be selectively latched in a manner to be described more fully hereinbelow. As best seen in FIGS. 7, 8 and 9, outer door wall 32*a* overlaps the opening of cabinet 20 along the top and bottom, as does outer door wall 31*a*.

Thus, when doors 31 and 32 are closed, cabinet 20 defines an inner protected air space surrounded on the top, bottom, sides, back and front by double-walled elements having insulating air spaces created therebetween. Thus articles placed within said cabinet 20 are protected from the effects of fire when said doors 31 and 32 are closed and latched.

In a preferred embodiment of the present invention, doors 31 and 32 remain normally in an open position, with means provided to automatically close and latch said doors in the event of fire. In the preferred embodiment illustrated in FIGS. 1 and 2, left door 31 is urged to a closed position by, for example, air cylinder 36, while right door 32 is similarly urged to a closed position by air cylinder 37.

Retaining means are provided to retain left door 31 in an open position, such as illustrated at 38. In a preferred embodiment, said retaining means 38 includes a fusible link 39 which, at a preselected ambient temperature, fuses or melts, thus releasing left door 31 and enabling cylinder 36 to pull said door into a closed position.

A similar retaining element 40 is used to hold right door 32 in an open position, and fusible link 41 similarly provides means to release right door 32 in the event of a rise in ambient temperature.

As best seen in FIG. 1, shaft 42 of air cylinder 36 is attached to left door link 43 which, in turn, is attached to outer door wall 31*a* of left door 31. As best seen in FIG. 7, left door 11 is preferably hinged to cabinet 20 by hinge 44 which extends substantially the full height of left door 31. A similar arrangement is contemplated for right door 32, whereby shaft 45 of air cylinder 37 is pivotally attached to right door link 46. Right door 32, in turn, is hinged upon hinge 47 which, again, extends substantially the full height of right door 32.

As best seen in FIG. 2, when left door 31 is closed, right door 32 may then be closed to engage sealing lip 33. Thus, during any automatic closing of doors 31 and 32, it is necessary that said doors close in sequence wherein left door 31 reaches a closed position prior to right door 32. This sequence must be maintained regardless of the sequence in which fusible links 39 and 41 melt.

A preferred embodiment to time the closing of doors 31 and 32 includes a timing slide bracket 48 which is positioned between top wall 30 and outer top wall 25 of cabinet 20. Timing slide bracket 48 is slidably mounted upon slide pivot stud 49, and may be moved left or right, limited by the dimensions of slot 50, formed in timing slide bracket 48 through which slide pivot stud 49 protrudes. Slide bracket spring 51 is attached to spring anchor 52, and at its other end, to timing slide bracket 48 at 53. Thus, timing slide bracket 48 is normally urged to a full righthand position, with slide pivot stud 49 positioned at the leftmost extreme of slot 50.

Actuating plate 54 is pivotally mounted to inner top wall 30 by actuating stud 55, and is pivotally attached to timing slide bracket 48 at 53. As seen in FIG. 1, actuating arm 54 has actuating stud 55 positioned in arcuate slot 59 formed in wall 30. Thus, rotation of actuation plate 54 about actuating stud 55 is limited and guided by slot 57.

As best seen in FIG. 2, when actuating plate 54 is moved in the direction indicated by A, timing slide bracket 48 is pulled in a leftward direction B.

As best seen in FIG. 5, timing slide bracket 48 has stop roller stud 56 mounted thereon. A partial elevation and side sectional view of stop roller stud 56, as seen in FIG. 6, illustrates that, in this preferred embodiment, stop roller stud 56 includes an outer rotatable collar 57 and a central stud shaft 58 upon which collar 57 is journalled.

When doors 31 and 32 to cabinet 20 are held open, and timing slide bracket 48 is positioned in its rightwardmost attitude, stop roller stud 56 is positioned as shown in FIG. 1. As best seen in FIG. 5, stop roller stud 56 will contact right door link 46 as right door 32 closes responsive to the release of door 32 by the fusing of fusible link 41 in retaining assembly 40. In this manner, the closing of door 32 will be arrested by stop roller stud 56.

As best illustrated in FIGS. 2 and 5, door 32 will remain partially open until timing slide bracket 48 moves leftward a sufficient distance to position stop roller stud 56 out of the path of door bracket 46. Such a position is illustrated in phantom at C of FIG. 5.

Movement of timing slide bracket 48 is accomplished as follows. When fusible link 39 has released door 31, said door 31 is drawn closed by air cylinder closure 36 about hinge 44 until inner door wall **31*b* contacts actuating plate 54. Sufficient force is thus exerted on actuating plate 54 to pivot it about actuating stud 55 thereby drawing timing slide bracket 48 leftward, in direction B, (FIG. 2) moving stud 56 to position C (FIG. 5) and allowing door 32 to complete its closing movement. In this manner, it is assured that door 31, with sealing lip 33, will close fully before door 32**, thus providing a protective seal.

Once closed, doors 31 and 32 must remain closed for maximum safety. To provide automatic latching capability, a latching assembly 59 is provided as seen in FIG. 7.

Said latching assembly 59 includes latch rod 60 having an upper inclined end **60*c* that is actuated upward out of the door opening 61 by spring means 62 attached to a latch guide bracket 63, as seen in FIGS. 3, 4, 7 and 8, within which latch rod 60 is maintained. As best seen in FIGS. 3 and 4, each such latch bracket 63 has an oval slot 64 formed therein, enabling latch rod 60** to be moved slightly in a horizontal direction.

As seen in FIGS. 8 and 9, upper latch bracket 63 is attached to the inner side of outer door wall **32*a***.

In a preferred embodiment, latch rod 60 includes an upper latch rod segment **60*a* and a lower latch rod segment 60*b*, as best seen in FIG. 7. When latch member 34 is in an unlatched position, handle 69 is held horizontally, as seen in phantom in FIG. 7. Upper and lower latch rod segments 60*a* and 60*b* are pivotally attached to latch assembly 34 in any conventionally known manner such that in an unlatched position, upper latch rod segment 60*a* is drawn downward and lower latch rod segment 60*b*** is drawn upward.

As best seen in FIGS. 8 and 9, inner top wall 30 has upper latch aperture 66 formed therethrough to register with the inclined end **60*c* of latch rod 60 when door 32 is closed. As seen from FIGS. 8 and 9, this inclined end does not protrude through the aperture unless the door is in its closed position. The straight portion 60 depending from the inclined end is slidably associated with the top wall opening so it causes the door to remain closed unless the inclined end is withdrawn from the opening by sliding the depending straight portion. A similar aperture is formed through inner floor 24, as indicated in FIG. 7. Thus, in its unlatched position, upper latch rod 60*a* is withdrawn from upper latch aperture 66, and lower latch rod segment 60*b* is withdrawn from lower latch aperture 67**.

In a preferred embodiment, latch rod segments **60*a* and 60*b* are normally in a latched position due to the urging of spring 62 forcing the inclined ends 60*c* outward of the latch aperture 66**. Thus the only time it is in an unlatched position is when the door is opened or closed due to the inclined end being forced downward inside the door.

With this improved system, the automatic latching of door 32 is attained without a latch stop mechanism as described in U.S. Pat. No. 4,262,448. As seen in FIGS. 8 and 9, when door 32 is completely closed, the latch lock **60*a* is in its outward position with its inclined end 60*c* protruding through the upper ledge aperture 66 of the inner top wall 30 and is held in such position by means of the spring 62. The automatic upward movement of latch rod segment 60*a* and corresponding lower movement of latch rod 60*b* no longer depends on a releasing shoulder but rather on the inclined end 60*c* of the latching rod being gradually depressed and eased into registry by means of the inclined surface of the inclined end 60*c*. Automatic upward movement of latch rod segment 60*a* and the corresponding lower movement of the latch rod 60*b* is still caused by latch rod spring 62 providing such stress that the rotation of the latch handle 59 to an unlatched position stresses spring 62. When the straight latch rod 60 is moved, the inclined end 60*c* is caused to protrude through the upper latch aperture 66, and the latch handle 59 is rotated to its closed position. However, when it is desired to open the door, the latch handle 59 is rotated to its open position, thereby enabling the inclined end 60*c* to be withdrawn into the door for clearance. Once the doors are open, the inclined ends are slid through the opening in the door so that they appear as pictured in FIG. 9** in the "closing" position.

While the foregoing has presented a specific embodiment of the invention herein, it is to be understood that this embodiment is presented by way of example only. It is expected that others skilled in the art will perceive variations which while differing from the foregoing do not depart from the spirit and scope of the invention as herein described and claimed.

What is claimed is:

1. In a closure mechanism for a cabinet, said cabinet of the type where said closure mechanism is adapted to close off said cabinet front, said closure mechanism comprising:

a pair of rotating doors called a first door and a second door, closing means to urge said first and second doors to a closed position, a timing means mounted to the interior of the cabinet to control the closing sequence of the doors, latching means to latch said doors in a closed position responsive to the closing of said doors;

means to prop said doors in an open position, said prop means including link means pivotally mounted to each said door, said link means being fashioned from heat fusible material whereby a selected rise in ambient temperature will fuse said link thereby releasing said door from its open position and allowing it to close when said timing means releases it for rotation to a closed position, the improvement comprising a latch assembly with a latching rod that includes an inclined outer end which forms an acute angle with an inner portion of said latching rod, said latching rod being spring biased outwardly to urge said inclined outer end out of an opening in one of the doors into engagement with the cabinet by having the outer inclined end protrude through an opening in the wall of the cabinet.

2. In a closure mechanism, as defined in claim 1, wherein said inclined outer end is slanted in a direction that enables said inclined end only to protrude through said opening in said cabinet wall when said door is in its closed position.

3. In a closure mechanism, as defined in claim 2, wherein said inclined end is operatively associated with a rotatably actuated latch mechanism that causes said inclined end to be withdrawn from said top wall opening, whereby said inclined end enables said second door to be openend when this is desired.

4. In a closure mechanism, as defined in claim 3, wherein said inclined outer end has a straight portion depending downward therefrom, said straight portion being slidably associated with a side of said cabinet wall opening as well as a side of upper door opening, whereby said straight portion causes said door to remain closed until said latch is rotated to withdraw said inclined end.

* * * * *

UNITED STATES PATENT AND TRADEMARK OFFICE

CERTIFICATE OF CORRECTION

PATENT NO. : 4,619,076

DATED : October 28, 1986

INVENTOR(S) : Jerry L. Livingston

It is certified that error appears in the above-identified patent and that said Letters Patent are hereby corrected as shown below:

| | |
|---|---|
| Col. 1, Line 63 | After "FIG.", insert --7--. |
| Col. 6, line 22 | Delete "openend", should instead be --opened--. |

Signed and Sealed this

Seventeenth Day of March, 1987

*Attest:*

DONALD J. QUIGG

*Attesting Officer*

*Commissioner of Patents and Trademarks*